US008016641B2

(12) United States Patent
Vincent et al.

(10) Patent No.: US 8,016,641 B2
(45) Date of Patent: Sep. 13, 2011

(54) METHOD FOR MANUFACTURING A GOLF CLUB HEAD

(75) Inventors: Brandon T. Vincent, Encinitas, CA (US); Robert S. Gonczi, Oceanside, CA (US)

(73) Assignee: Callaway Golf Company, Carlsbad, CA (US)

( * ) Notice: Subject to any disclaimer, the term of this patent is extended or adjusted under 35 U.S.C. 154(b) by 192 days.

(21) Appl. No.: 12/388,317

(22) Filed: Feb. 18, 2009

(65) Prior Publication Data

US 2010/0210183 A1 Aug. 19, 2010

(51) Int. Cl.
*B24B 1/00* (2006.01)

(52) U.S. Cl. ..... 451/32; 451/34; 451/35

(58) Field of Classification Search ..... 451/32, 451/34, 35

See application file for complete search history.

(56) References Cited

U.S. PATENT DOCUMENTS

| | | | | | |
|---|---|---|---|---|---|
| 3,371,449 | A * | 3/1968 | Olson et al. | 451/32 |
| 3,464,163 | A * | 9/1969 | Ferrara | 451/113 |
| 3,611,638 | A * | 10/1971 | Deede | 451/113 |
| 4,027,885 | A | 6/1977 | Rogers | |
| 4,077,632 | A | 3/1978 | Taylor | |
| 4,558,505 | A | 12/1985 | Moore | |
| 4,768,787 | A | 9/1988 | Shira | |
| 5,049,166 | A * | 9/1991 | Kirkendall | 51/293 |
| 5,354,059 | A | 10/1994 | Stuff | |
| 5,487,543 | A | 1/1996 | Funk | |
| 5,766,087 | A * | 6/1998 | Kawamatsu | 473/290 |
| 5,829,131 | A * | 11/1998 | DeSloover et al. | 29/888.1 |
| 5,873,770 | A * | 2/1999 | Hashimoto | 451/32 |
| 6,059,670 | A | 5/2000 | Mogan | |
| 6,193,615 | B1 | 2/2001 | Hirota | |
| 6,482,107 | B1 * | 11/2002 | Urbanski et al. | 473/331 |
| 7,179,175 | B2 | 2/2007 | Kennedy, III | |
| 7,452,283 | B2 | 11/2008 | Hettinger et al. | |
| 7,473,187 | B2 | 1/2009 | Vokey et al. | |
| 2004/0192460 | A1 * | 9/2004 | Sherwood | 473/290 |
| 2008/0167138 | A1 * | 7/2008 | Ban et al. | 473/331 |
| 2010/0113179 | A1 * | 5/2010 | Solheim | 473/331 |

* cited by examiner

*Primary Examiner* — Maurina Rachuba

(74) *Attorney, Agent, or Firm* — Michael A. Catania; Rebecca Hanovice; Sonia Lari

(57) ABSTRACT

A method for manufacturing a golf club head having scorelines is disclosed herein. The method includes tumbling a raw cast golf club head in a tumbler containing a rough cut media. The tumbling occurs for at least six hours to create a tumbled golf cub head. The method also includes grinding the tumbled golf club head to clean a perimeter of the tumbled golf club head to create a ground golf club head. The method also includes polishing the ground golf club head to create a polished golf club head. The method also includes finishing the golf club head to create a finished golf club head.

20 Claims, 8 Drawing Sheets

METHOD FOR MANUFACTURING A GOLF CLUB HEAD

CROSS REFERENCES TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

The present invention relates to a method for manufacturing a golf club head with scorelines. More specifically, the present invention relates to method for manufacturing a golf club head with scorelines utilizing a tumbling process.

2. Description of the Related Art

The prior art discloses various methods to manufacture golf club heads, especially iron-type golf club heads. For example, Rogers, U.S. Pat. No. 4,027,885 for Golf Iron Manufacture, discloses scoring grooves into a face for the club head.

Taylor, U.S. Pat. No. 4,077,632 for a Lined Face For A Golf Club discloses grooves in compliance with the Rules of Golf at that time.

Moore, U.S. Pat. No. 4,558,505, for a Method of Making Weighted Metal Golf Club Head discloses at process for making an iron-type golf club head.

Shira, U.S. Pat. No. 4,768,787, for a Golf Club Including High Friction Striking Face discloses grit blasting the horizontal grooves to provide a friction generating surface when the striking surface of the golf club head engages a ball.

Stuff, U.S. Pat. No. 5,354,059, for Golf Club Heads With Means For Imparting Corrective Action, discloses a club head with at least two non-parallel sets of grooves.

Funk, U.S. Pat. No. 5,487,543, for a Shot Peened Golf Club Head, discloses shot peening the striking surface of a golf club head.

Mogan, U.S. Pat. No. 6,059,670, for a Golf Club Having A Head With A Hard Multilayer Striking Surface And Method For Making The Same, discloses manufacturing a club head by heat treatments, vacuum treatments, and roughening.

Doolen, U.S. Pat. No. 6,179,725, for a Golf Club Having Angular Grooves discloses grooves oriented at various angles.

Hirota, U.S. Pat. No. 6,193,615, for a Head Of Golf Clubs That Spins More, discloses a face having grooves that allow for pressure to act specially on the edges of the grooves to increase ball spin.

Vokey et al, U.S. Pat. No. 7,473,187, for Spin Milled Grooves For A Golf Club, discloses machining grooves into a face.

Hettinger et al., U.S. Pat. No. 7,452,283, for a Putterhead With Dual Milled Face Pattern, discloses milling grooves into a face of a putter.

Kennedy, III, U.S. Pat. No. 7,179,175, for a Golf Club Having Stepped Grooves, discloses a golf club head with V-shaped and U-shaped grooves.

Scoreline designs generally have a cross-section geometry that includes two edges, two side walls and a bottom. The side walls are at a predetermined angle from a vertical line. Usually, each wall has more than one section and those sections are straight or curved. Alternatively, the scoreline design is a "V" shape, in which case there is no bottom other than a vertex or fillet radius.

Iron-type golf clubs having scorelines with sharp edges and relatively vertical side walls are advantageous to golfers since such sharp edged grooves allow golfers to induce higher levels of spin on a ball struck with such an iron-type golf club having sharp edged grooves. Iron-type golf clubs without sharp edged grooves or essentially vertical side walls will induce less spin when impacting a golf ball, especially higher-lofted (40 degrees+) golf clubs.

Traditionally, grinding has been used for material removal of iron-type golf clubs, but process variation during grinding has resulted in scoreline edges that are too sharp or scoreline widths that are too inconsistent.

Previous methods also used several belting steps to grind and skin the club head before finishing.

Other methods of scoreline fabrication such as machining or forming are too expensive or impractical to be used with cast iron-type golf clubs.

BRIEF SUMMARY OF THE INVENTION

The present invention overcomes the problems of the prior art.

One aspect of the present invention is a method for manufacturing a golf club head having scorelines. The method includes tumbling a raw cast golf club head. The golf club head has scorelines. The tumbling is performed in a tumbler containing a rough cut media. The tumbling occurs for at least six hours to create a tumbled golf cub head. The method also includes grinding the tumbled golf club head to clean a perimeter of the tumbled golf club head to create a ground golf club head. The method also includes polishing the ground golf club head to create a polished golf club head. The method also includes finishing the golf club head to create a finished golf club head.

Each of the plurality of scorelines preferably has a groove width of at least 0.01 inch. Each of the plurality of scorelines preferably has a depth of at least 0.01 inch. Each of the plurality of scorelines preferably has a depth ranging from 0.016 inch to 0.022 inch. Each of the plurality of scorelines preferably has a width ranging from 0.030 inch to 0.037 inch. Each of the plurality of scorelines preferably has a side wall angle ranging between 34 and 40 degrees relative to vertical. The side wall angle of each of the side walls of each of the plurality of scorelines preferably is within two degrees of each other.

Another aspect of the present invention is a method for manufacturing an iron-type golf club head having a plurality of grooves. The method includes tumbling a raw cast golf club head. The golf club head has a plurality of grooves, and each of the plurality of grooves has an edge sharpness of at least thirty-five degrees. The tumbling is performed in a tumbler containing a rough cut media. The tumbling occurs for at least six hours to create a tumbled golf cub head. The method also includes grinding the tumbled golf club head to clean a perimeter of the tumbled golf club head to create a ground golf club head. The method also includes polishing the ground golf club head to create a polished golf club head. The method also includes finishing the golf club head to create a finished golf club head.

Yet another aspect of the present invention is a method for manufacturing an iron-type golf club head having grooves. The method includes tumbling a raw cast iron-type golf club head in a vibe bowl having a volume of 300 to 500 liters and containing a rough cut media comprising a plurality of aluminum oxide in ceramic having dimensions between 15 mm to 25 mm with the tumbling occurring for at least six hours to create a tumbled iron-type golf cub head. The method also includes grinding the tumbled iron-type golf club head to clean a perimeter of the tumbled iron-type golf club head to create a ground iron-type golf club head. The method also includes polishing the ground iron-type golf club head to create a polished iron-type golf club head. The method also includes finishing the polished iron-type golf club head to create a finished iron-type golf club head.

The method may also include further tumbling the tumbled iron-type golf club head in a vibe bowl having a volume of 300 to 500 liters and containing a medium cut media comprising a plurality of aluminum oxide in ceramic having dimensions between 15 mm to 25 mm, the tumbling occurring for at least three hours.

A distance between each of the plurality of scorelines preferably ranges from 0.070 inch to 0.115 inch. An edge radius of each of the plurality of scorelines preferably is no greater than 0.003 inch. Each of the plurality of scorelines preferably has a side wall angle ranging between 34 and 40 degrees relative to vertical for the top one-third of the groove and the lower two-thirds of the groove has a different side wall angle.

Another aspect of the present invention is a method that removes fifty percent or more of the material thickness from the face wall of a raw casting (commonly called polishing stock or grind stock) of an iron-type golf club head utilizing a vibratory tumbling process.

50% or more of the material thickness removed from the face of the raw casting (commonly called polishing stock or grind stock) is accomplished using a drag finishing process (rather than a grinding, belting or polishing type process).

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
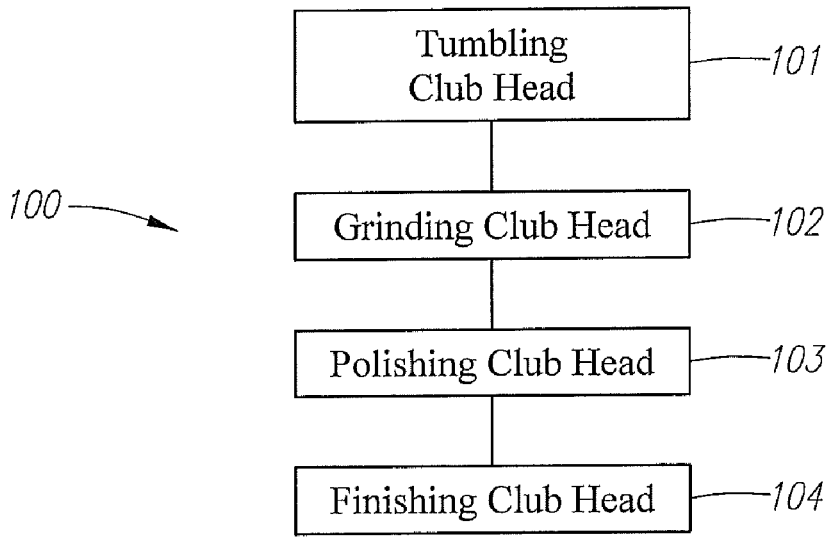
FIG. 1 is a flow chart of a general method of a preferred embodiment.
Figure 2:
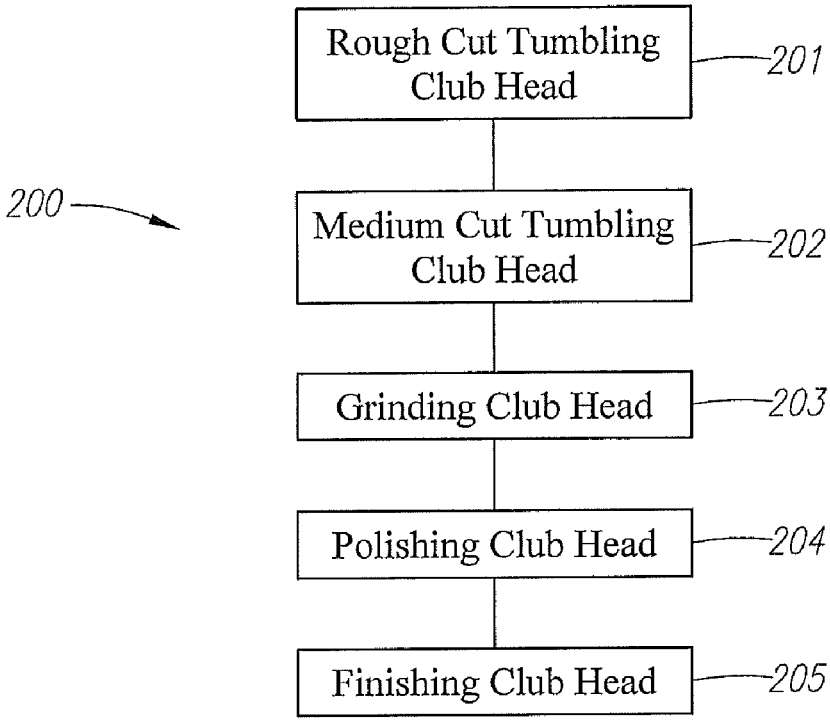
FIG. 2 is a flow chart of a specific method of a preferred embodiment.
Figure 3:
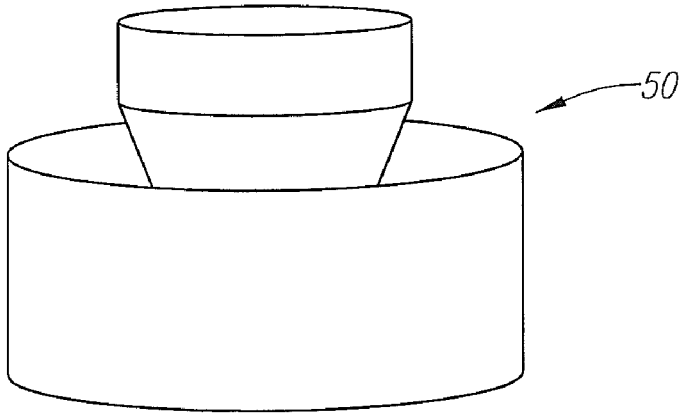
FIG. 3 is a side view of a vibratory tumbler utilized with a method of manufacturing golf club heads.
Figure 4:
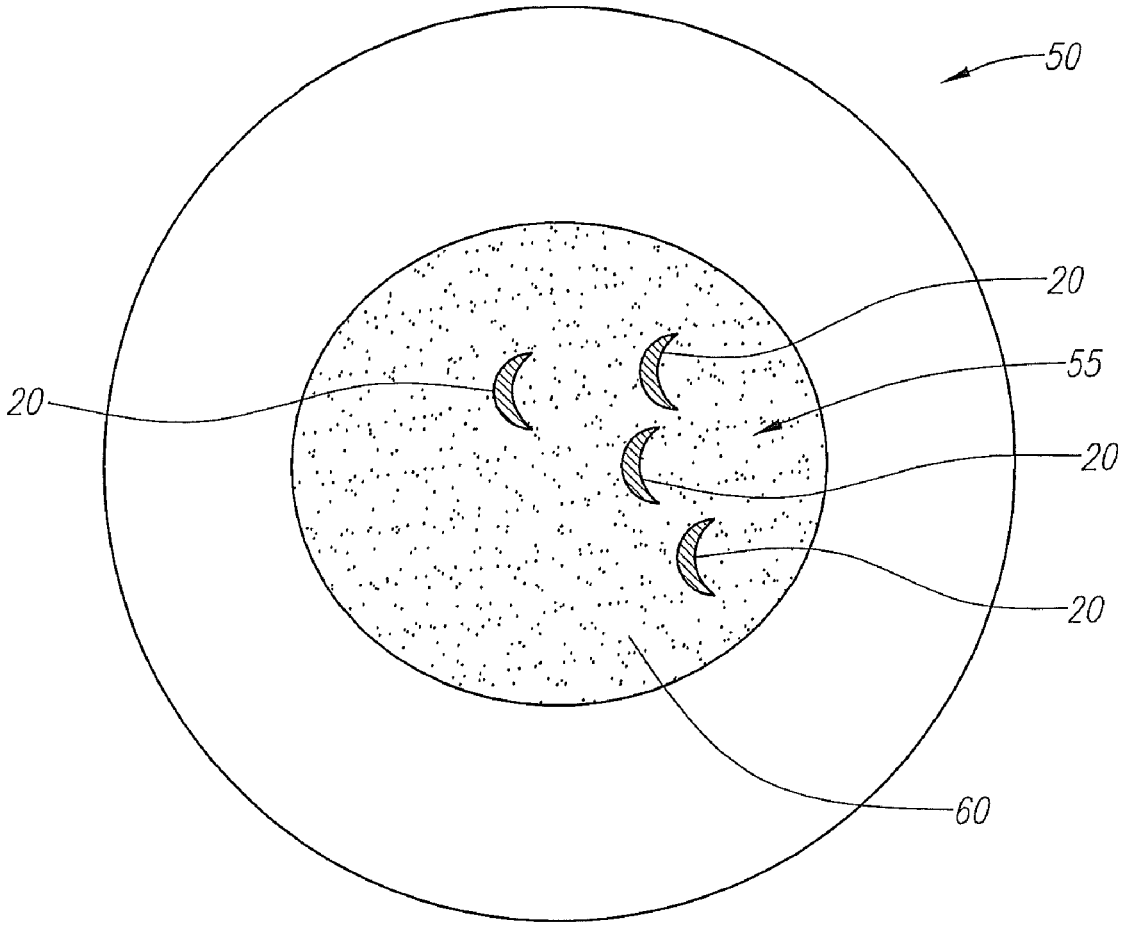
FIG. 4 is a top plan view of a vibratory tumbler utilized with a method of manufacturing golf club heads, with rough cut media in a vibratory bowl along with unfinished golf club heads.

As shown in FIG. 1, a general method of a preferred embodiment for manufacturing golf club heads is designated 100. At block 101, golf club heads are tumbled, preferably in a tumbler containing a rough cut media, and the tumbling preferably occurs for at least six hours. A tumbler 50, as shown in FIGS. 3 and 4, preferably has a 300 liters to 500 liters capacity, and rough cut media 60, such as aluminum oxide having dimensions of 15 millimeters ("mm") to 25 mm, is tumbled in a vibratory bowl 55 along with raw cast golf club heads 20 during the tumbling process. At block 102, the tumbled club head is ground to clean a perimeter of the club head. At block 103, the ground club head is polished, typically with a belting process. At block 104, the club head is finished.

A more specific method of a preferred embodiment for manufacturing golf club heads is designated 200. At block 201, raw cast golf club heads are tumbled, preferably in a tumbler containing a rough cut media, and the tumbling preferably occurs for at least six hours. At block 202, golf club heads are tumbled, preferably in a tumbler containing a medium cut media, and the tumbling preferably occurs for at least six hours. At block 203, the tumbled club head is ground to clean a perimeter of the club head. At block 204, the ground club head is polished, typically with a belting process. At block 205, the club head is finished.

Figure 5:
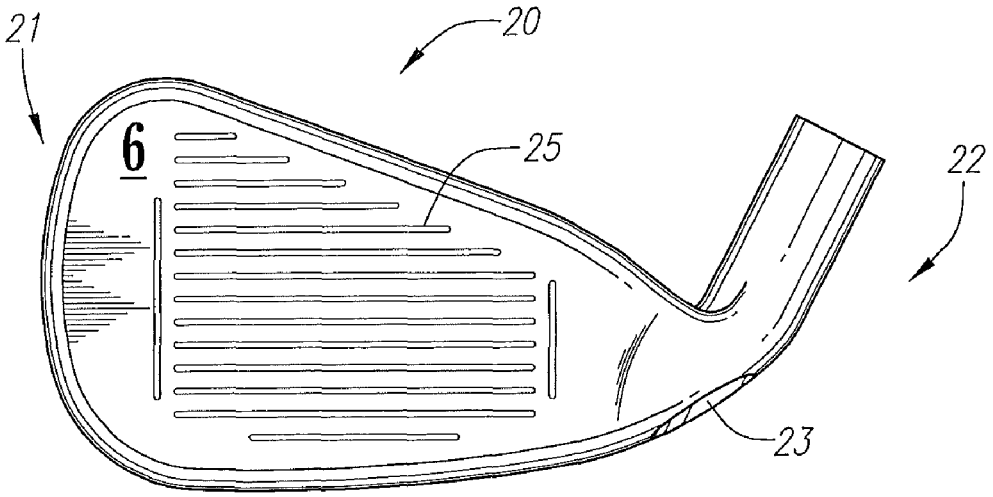
FIG. 5 is a top perspective view of raw casting of an iron-type golf club head.
Figure 5A:
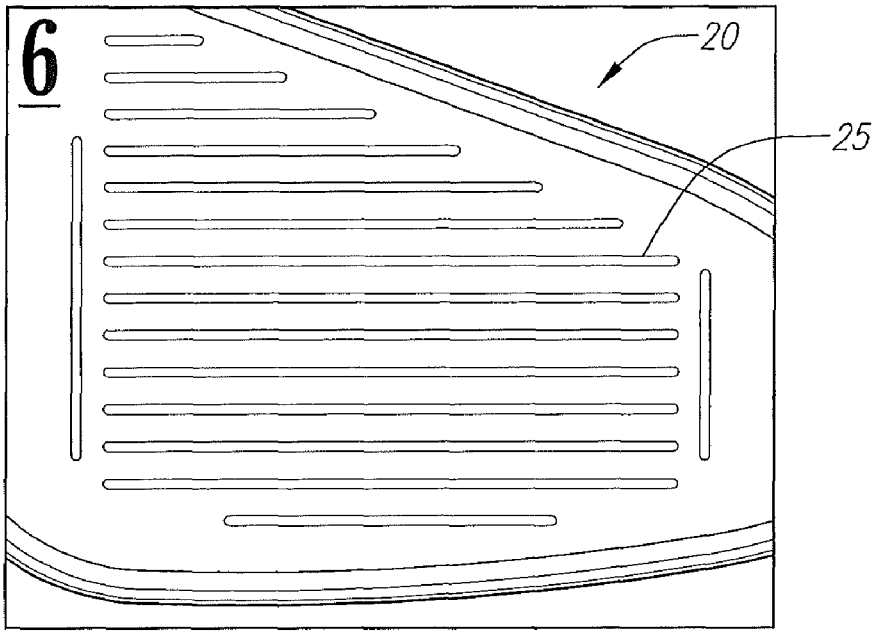
FIG. 5A is an enlarged view of FIG. 5.

FIGS. 5 and 5A illustrate raw cast iron-type golf club heads 20 having grooves 25. The iron-type golf club head 20 has a toe end 21, a heel end 22 and a face 23.

Figure 6:
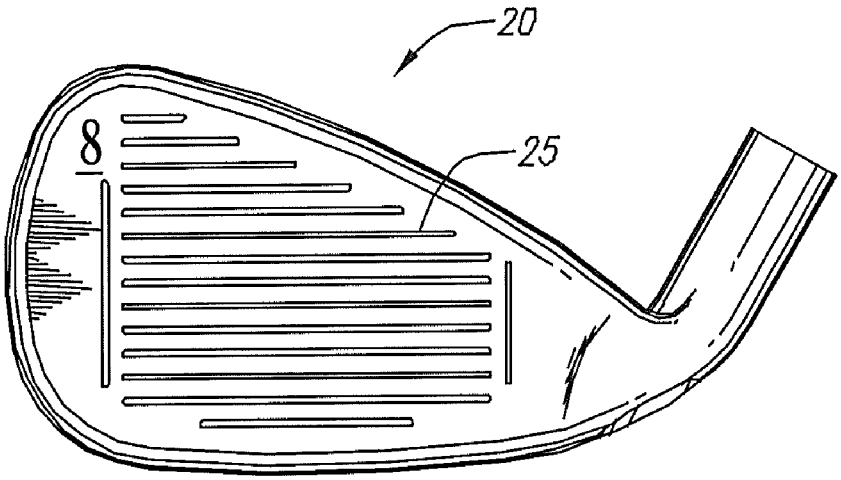
FIG. 6 is a top perspective view of a tumbled iron-type golf club head.
Figure 6A:
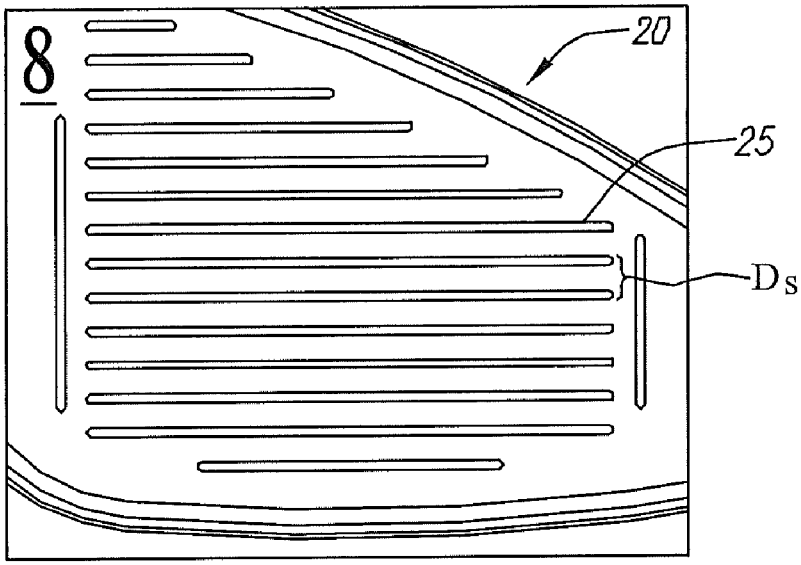
FIG. 6A is an enlarged view of FIG. 6.

FIGS. 6 and 6A illustrate a tumbled golf club head 20 with grooves 25 retaining a side wall angle between 35 and 40 degrees relative to vertical.

Figure 7:
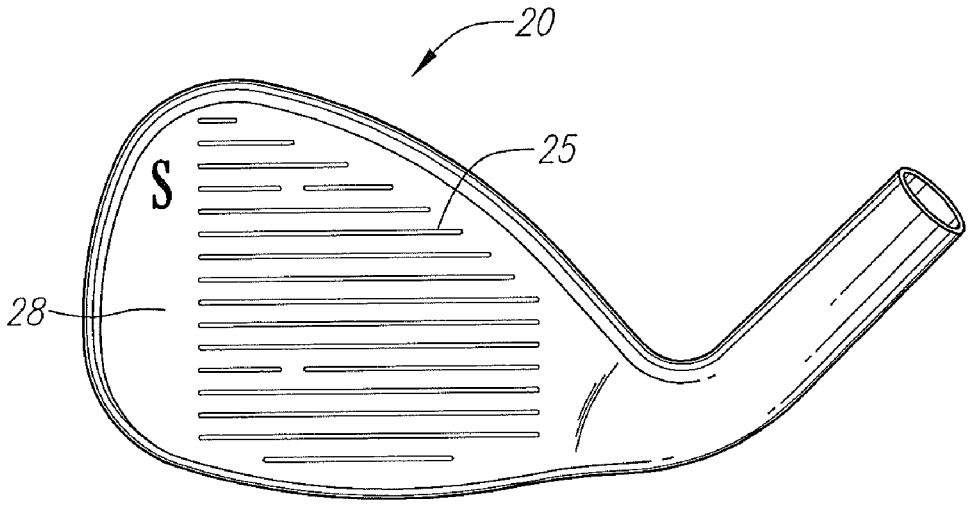
FIG. 7 is a top perspective view of a belted iron-type golf club head.
Figure 7A:
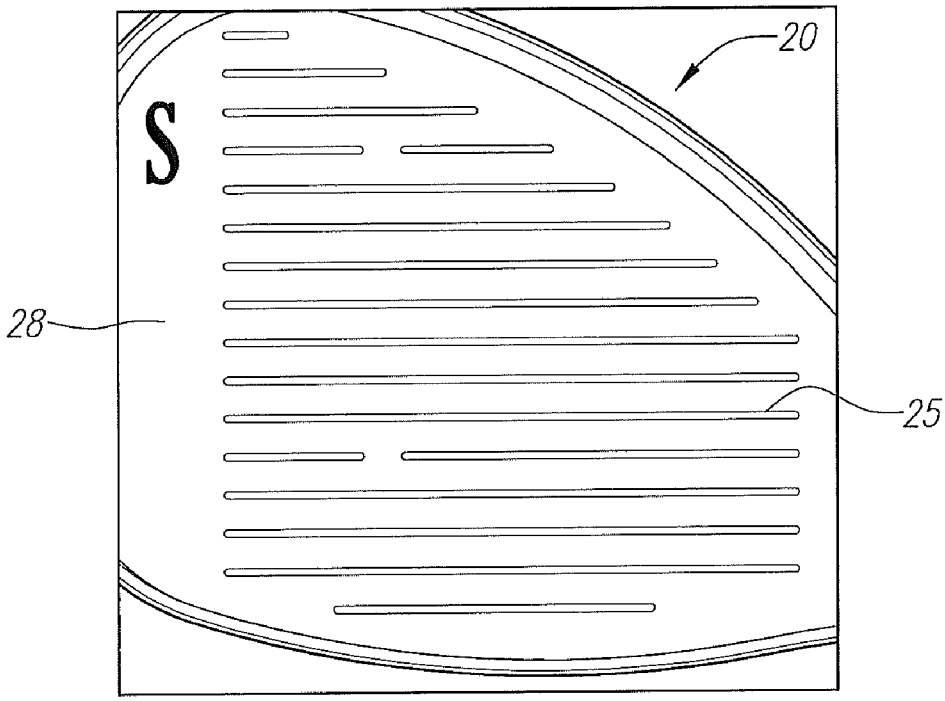
FIG. 7A is an enlarged view of FIG. 7.

FIGS. 7 and 7A illustrate a pre-tumbled golf club head 20 with grooves 25 after a shell removal.

Figure 8:
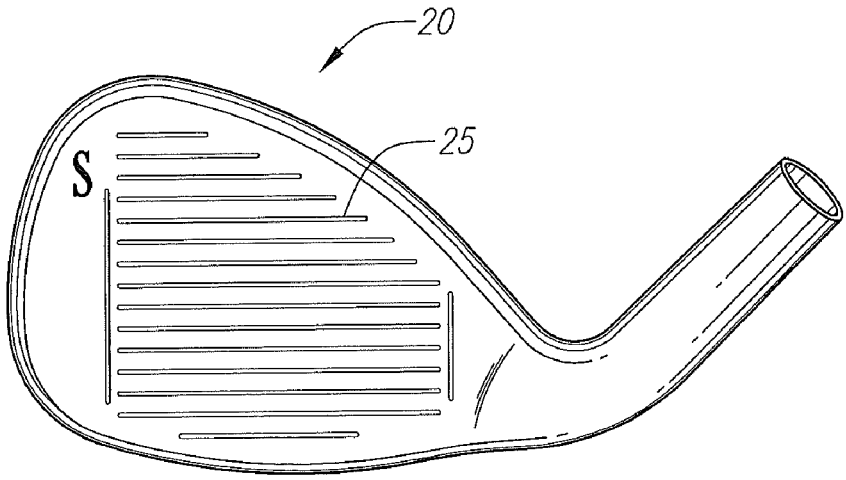
FIG. 8 (PRIOR ART)
FIG. 8 is a top perspective view of conventionally finished iron-type golf club head.
Figure 8A:
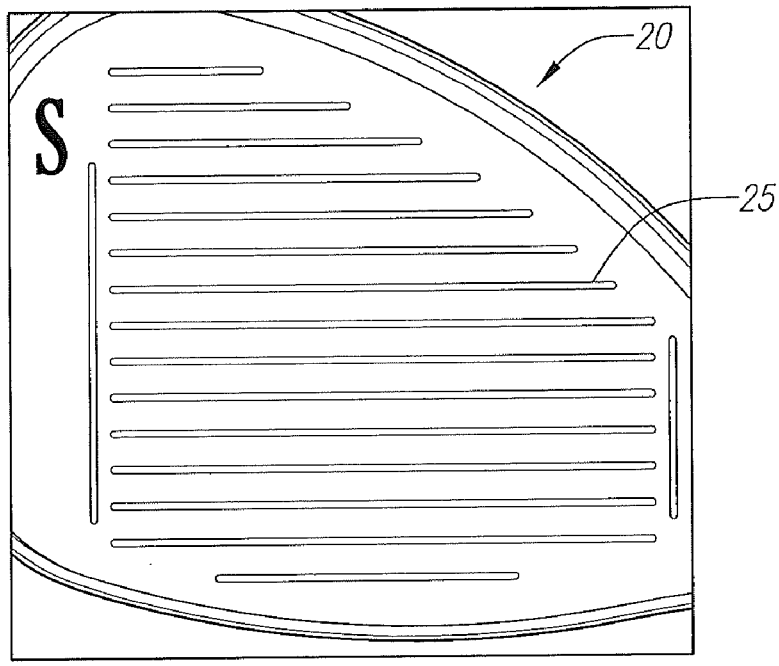
FIG. 8A (PRIOR ART)
FIG. 8A is an enlarged view of FIG. 8.
Figure 9:
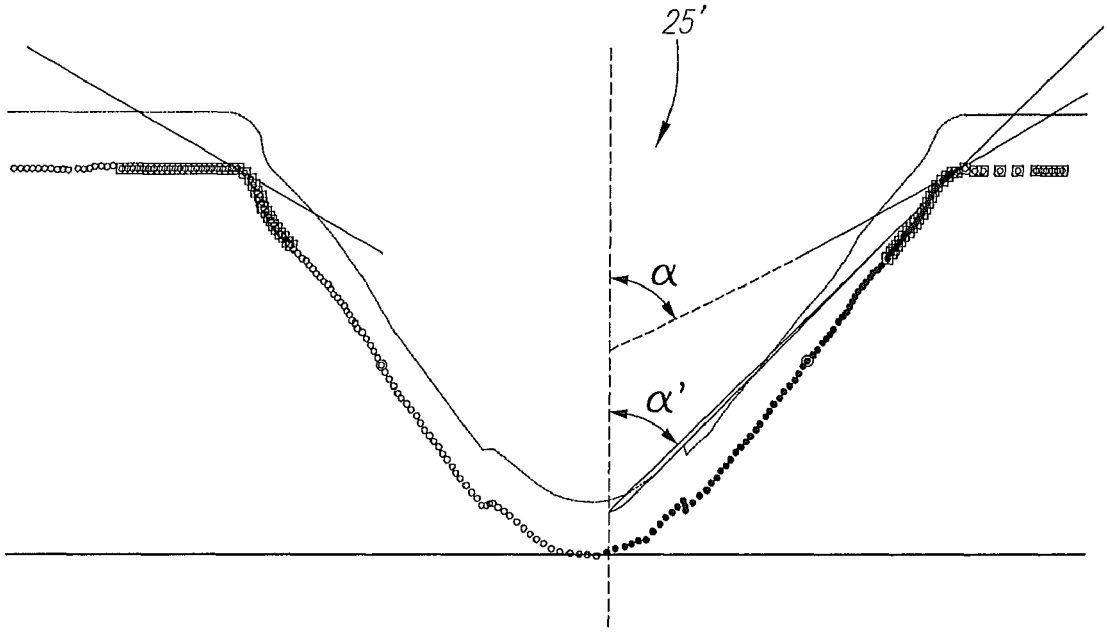
FIG. 9 (PRIOR ART)
FIG. 9 is a cross-sectional view of a groove of the prior art.
Figure 10:
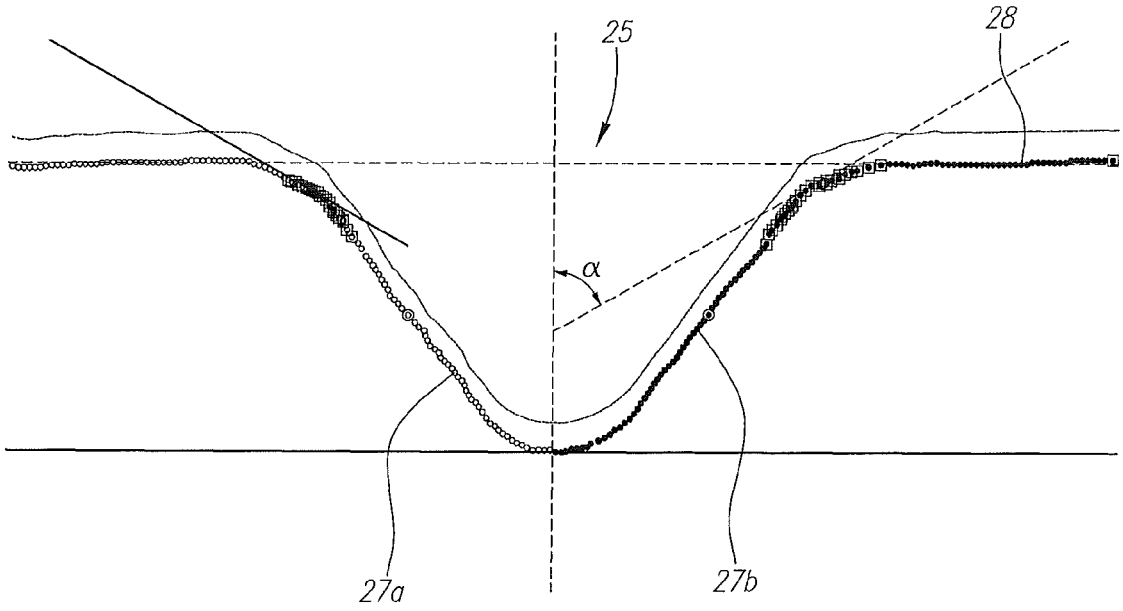
FIG. 10 is a cross-sectional view of a groove that has been tumbled, and illustrating a side wall angle a of the groove.
Figure 11:
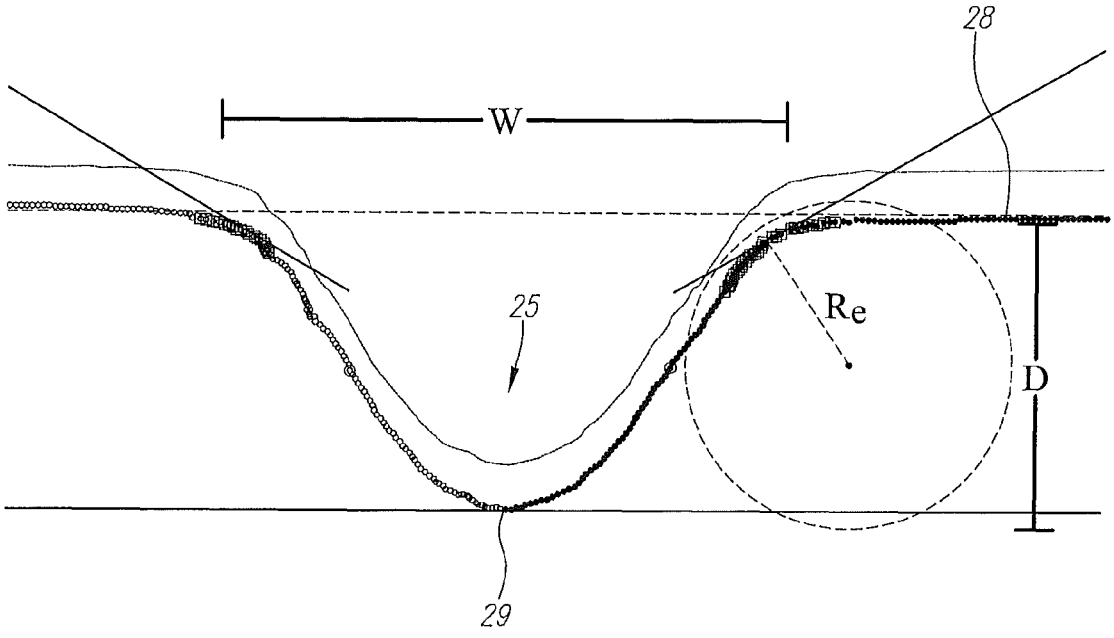
FIG. 11 is a cross-sectional view of a groove that has been tumbled, and illustrating a side wall edge radius Re of the groove, along with a groove depth, "D", and a groove width, "W."

FIGS. 8 and 8A illustrate a golf club head 20' with grooves 25' manufactured using a traditional process. FIG. 9 illustrates a groove 25' of a conventional belting process wherein a side wall angle $\alpha'$ relative to vertical is greater than a side wall angle $\alpha$ relative to vertical, which is preferably between 35 and 40 degrees. As shown in FIG. 10, a tumbled groove (groove after a tumbling process as described herein) has a side wall angle $\alpha$ relative to vertical preferably ranging between 35 and 40 degrees. As shown in FIG. 11, a groove 25 preferably has a width, W, ranging from 0.030 inch to 0.037 inch. The width is defined as the distance across a groove 25 from an inflection point of one end to an inflection point of the opposing end. Also, as shown in FIG. 11, a groove 25 preferably has a depth, "D", ranging from 0.016 inch to 0.022 inch. The depth is defined as the distance from a face surface 28 to a bottom of the groove 29. Also, as shown in FIG. 11, a groove 25 preferably has an edge radius "Re", no greater than 0.003 inch, wherein the edge radius is a transition from a groove 25 to a face surface 28. Further, as shown in FIG. 6A, a distance between grooves 25 is preferably between 0.070 inch and 0.115 inch. Further, as shown in FIG. 10, each side wall 27*a* of a groove 25 preferably has a side wall angle within two degrees of the side wall angle the opposing side wall 27*b*.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention the following:

1. A method for manufacturing a golf club head having scorelines, the method comprising:

tumbling a raw cast golf club head, the golf club head having scorelines, the tumbling performed in a tumbler containing a rough cut media, the tumbling occurring for at least six hours to created a tumbled golf cub head, wherein at least 50% of the material thickness of a face of the raw cast iron-type golf club head is removed during the tumbling;

grinding the tumbled golf club head to clean a perimeter of the tumbled golf club head to create a ground golf club head;

polishing the ground golf club head to create a polished golf club head;

finishing the golf club head to create a finished golf club head.

2. The method according to claim 1 wherein the golf club head is an iron-type golf club head.

3. The method according to claim 1 wherein each of the plurality of scorelines has a groove width of at least 0.01 inch.

4. The method according to claim 1 wherein each of the plurality of scorelines has a depth of at least 0.01 inch.

5. The method according to claim 1 wherein each of the plurality of scorelines has a depth ranging from 0.016 inch to 0.022 inch.

6. The method according to claim 1 wherein each of the plurality of scorelines has a width ranging from 0.030 inch to 0.037 inch.

7. The method according to claim 1 wherein each of the plurality of scorelines has a side wall angle ranging between 34 and 40 degrees relative to vertical.

8. The method according to claim 1 wherein side wall angles of each of the side walls of each of the plurality of scorelines is within two degrees of each other.

9. The method according to claim 1 wherein a distance between each of the plurality of scorelines ranges from 0.070 inch to 0.115 inch.

10. The method according to claim 1 wherein an edge radius of each of the plurality of scorelines is no greater than 0.003 inch.

11. The method according to claim 1 wherein each of the plurality of scorelines has a side wall angle ranging between 34 and 40 degrees relative to vertical for the top one-third of the groove and the lower two-thirds of the groove has a different side wall angle.

12. A method for manufacturing a golf club head having a plurality of grooves, the method comprising:

tumbling a raw cast golf club head, the golf club head having a plurality of grooves, each of the plurality of grooves having an edge sharpness of at least thirty-five degrees, the tumbling performed in a tumbler containing a rough cut media, the tumbling occurring for at least six hours to created a tumbled golf cub head, wherein at least 50% of the material thickness of a face of the raw cast iron-type golf club head is removed during the tumbling;

grinding the tumbled golf club head to clean a perimeter of the tumbled golf club head to create a ground golf club head;

polishing the ground golf club head to create a polished golf club head;

finishing the golf club head to create a finished golf club head.

13. The method according to claim 12 wherein each of the plurality of grooves has a groove width of at least 0.01 inch.

14. The method according to claim 12 wherein each of the plurality of grooves has a depth of at least 0.01 inch.

15. The method according to claim 12 wherein each of the plurality of grooves has a depth ranging from 0.016 inch to 0.022 inch.

16. The method according to claim 12 wherein each of the plurality of grooves has a width ranging from 0.030 inch to 0.037 inch.

17. The method according to claim 12 wherein each of the plurality of grooves has a side wall angle ranging between 35 and 40 degrees relative to vertical.

18. The method according to claim 12 wherein side wall angles of each of the side walls of each of the plurality of grooves is within two degrees of each other.

19. A method for manufacturing an iron-type golf club head having a plurality of grooves, the method comprising:

tumbling a raw cast iron-type golf club head, the iron-type golf club head having a plurality of grooves, each of the plurality of grooves having an edge sharpness of at least thirty-five degrees and a depth ranging from 0.016 inch to 0.022 inch, the tumbling performed in a vibe bowl having a volume of 300 to 500 liters and containing a rough cut media comprising a plurality of aluminum oxide in ceramic having dimensions between 15 mm to 25 mm, the tumbling occurring for at least six hours to create a tumbled iron-type golf cub head wherein at least 50% of the material thickness of a face of the raw cast iron-type golf club head is removed during the tumbling;

grinding the tumbled iron-type golf club head to clean a perimeter of the tumbled iron-type golf club head to create a ground iron-type golf club head;

polishing the ground iron-type golf club head to create a polished iron-type golf club head;

finishing the polished iron-type golf club head to create a finished iron-type golf club head.

20. The method according to claim 19 further comprising tumbling a tumbled iron-type golf club head in a vibe bowl having a volume of 300 to 500 liters and containing a medium cut media comprising a plurality of aluminum oxide in ceramic having dimensions between 15 mm to 25 mm, the tumbling occurring for at least three hours.

* * * * *